US006090204A

United States Patent [19]

Speed et al.

[11] Patent Number: 6,090,204

[45] Date of Patent: Jul. 18, 2000

[54] DOOR FINISHING SUPPORT FIXTURE

[76] Inventors: Richard Lewis Speed; Dustin Miles Speed, both of 3307 Palmetto, Amarillo, Tex. 79106

[21] Appl. No.: 09/072,208

[22] Filed: May 1, 1998

[51] Int. Cl.[7] ..... B05C 13/02

[52] U.S. Cl. ..... 118/500; 118/502; 269/905; 248/201; 248/216.1; 248/684

[58] Field of Search ..... 118/500, 502; 294/61; 248/201, 216.1, 217.3, 684; 269/53, 54.1–54.5, 905

[56] References Cited

U.S. PATENT DOCUMENTS 482,771 9/1892 Webster ..... 118/502
1,581,960 4/1926 King ..... 269/905
5,090,648 2/1992 Wood, IV ..... 269/905
5,164,011 11/1992 Ray ..... 118/502

*Primary Examiner*—Laura Edwards

[57] ABSTRACT

Support fixtures to aid in painting or otherwise finishing doors is disclosed. When four of these support fixtures are attached to the end corners of a door they support the door above the adjacent surface and the door can be turned using the attached handles. This allows all desired surfaces of the door to be finished at one time. A second door similarly equipped with these support fixtures can be likewise finished and then stacked on top of the first door with the finished surfaces of both doors maintained apart. These support fixtures are portable and reuseable.

4 Claims, 5 Drawing Sheets

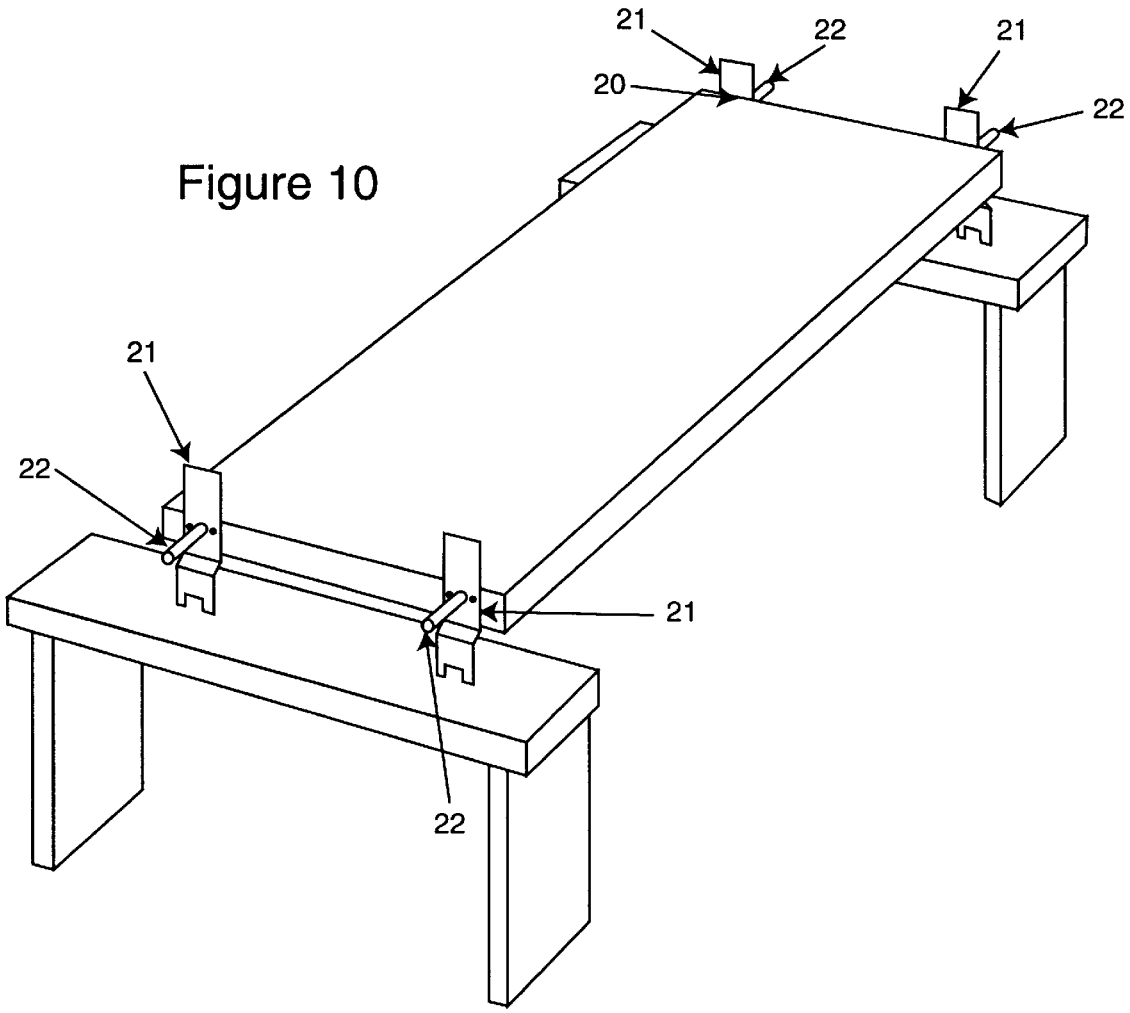
Figure 10
Figure 11
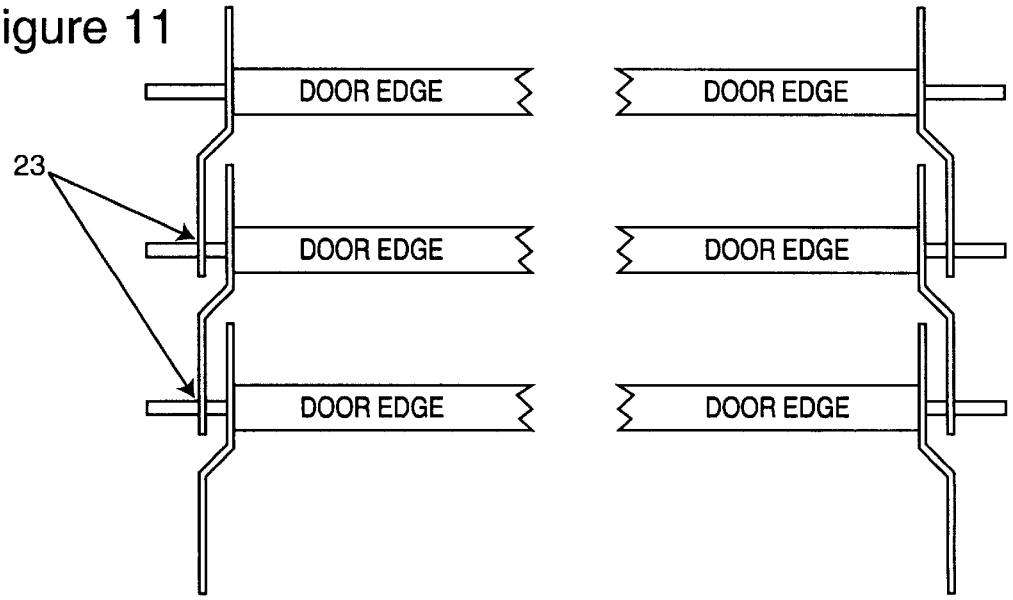

DOOR FINISHING SUPPORT FIXTURE

BACKGROUND OF THE INVENTION

1. Field of the Invention

The present invention relates generally to devices that will allow doors to be painted on both sides in the horizontal position and then stacked to dry.

2. Prior Art

During the course of their work, professional painters typically paint or otherwise finish doors, of the type commonly found in houses and other buildings, either installed in the frame or leaning against a wall or other structure. Finishing a door in the vertical position, especially when using an airless or other type paint sprayer, can result in runs or sags in the finish due to gravity, and overspraying onto adjacent surfaces. Also, since a typical construction site can range from very cluttered and dirty to well-maintained, but is rarely pristine, a door resting on or near the floor may have dirt or debris from the floor blown onto it by the sprayer as the finish is applied. If the door being finished is leaning against another structure, the finish must be applied to first one side, allowed to dry, turned, and the finish applied to the other side, a time consuming process.

Laying a door flat and horizontal across two sawhorses or other fixture eliminates some of the associated problems, but the necessity of allowing one side to dry before the other side can be finished remains a problem.

Available space and/or sawhorses determines how many doors can be finished at one time. Also, one door must be finished and allowed to dry on both sides before it can be moved to allow space for another door to be finished.

A device is available for use in finishing doors in the vertical position, whereby the door is suspended in a frame and the door can be rotated in order to finish both sides. However, these devices are large and expensive.

Another device is available in which several doors stand vertically on the floor and are joined on the top edge with an angled piece of metal, whereby the joined doors stand in a zig-zagged pattern and can be finished in this position. This device would possibly be difficult to facilitate in view of the height of a typical door and/or the relative bulkiness of several doors joined together.

With both of the aforementioned devices the problems of runs and sags in the finish still exist, as does the problem of dirt and debris from the floor and available space in the work area.

SUMMARY OF THE INVENTION

It is a first object of the present invention to provide devices that, when attached to a door, will allow that door to be finished in the flat, horizontal position to eliminate sagging and running of the finishing product.

It is a second object of the present invention to provide such devices that, when attached to a door, and with the door being in the flat, horizontal position, allow that door to be finished on one side, turned while the first side is still wet, and the other side finished, without marring the finish on either side or the edges of the door, and thus allowing for simultaneous drying of the entire door.

It is a further object of the present invention to provide such devices whereby a door, with such devices attached, can be laid in a flat, horizontal position on two sawhorses or other similar fixtures, thus rendering the door away from the dirt and debris on the floor and at a desirable working height for preparing and finishing, and once finished can immediately be moved from the sawhorses and set aside, freeing the sawhorses for finishing another door or for another task.

It is another object of the present invention to provide such devices that will allow doors, with such devices attached, to be finished and then allow the newly finished doors to be stacked in the flat, horizontal position one on top of the other with the finished surfaces of the doors being kept from coming into contact with other surfaces, and will allow the doors to dry in this position, thereby occupying less space in the work area than the unstacked doors would occupy.

It is an additional object of the present invention to provide such a device that is inexpensive, small, lightweight so as to be portable, and is reuseable and simple to attach and remove.

These and other objects of the present invention will become readily apparent upon further review of the following specifications and drawings.

BRIEF DESCRIPTION OF THE DRAWINGS

FIG. 10 is a perspective view of the fixture of FIG. 1 in combination with a door and sawhorses.

FIG. 11 is a side elevation of the fixture of FIG. 1 in combination with a fragmentary side elevation of doors.

DETAILED DESCRIPTION

Figure 1:
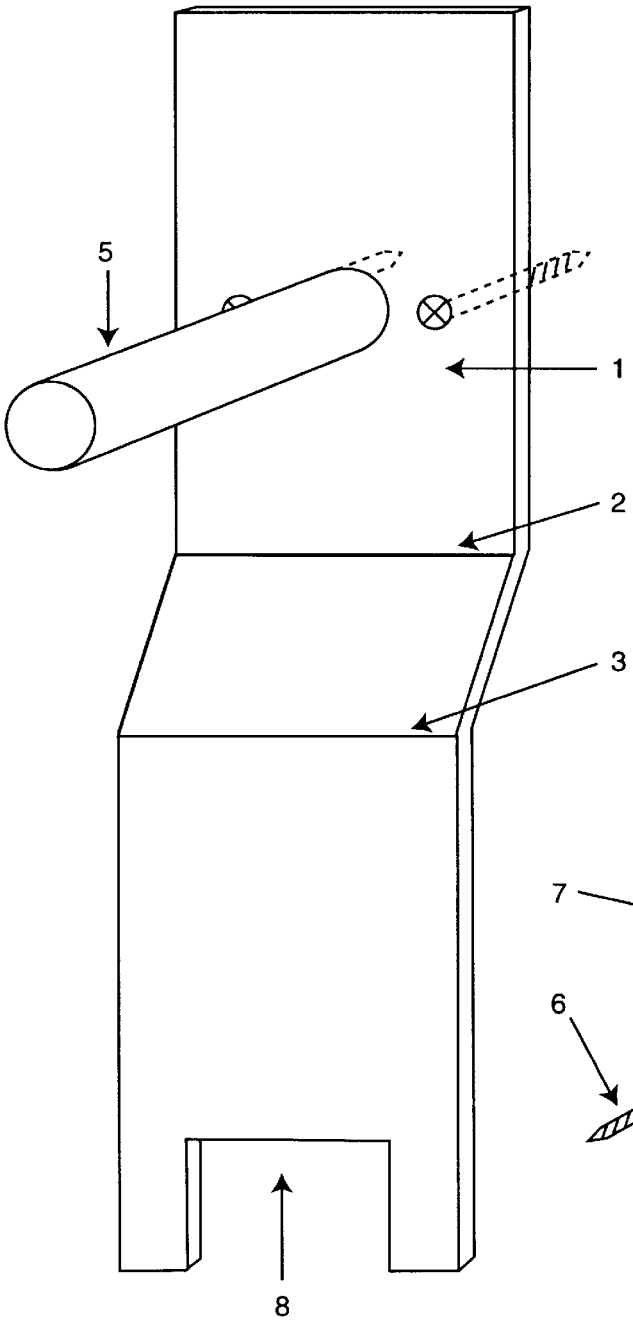
FIG. 1 is a front perspective of a door finishing support fixture in accordance with the present invention.
Figure 2:
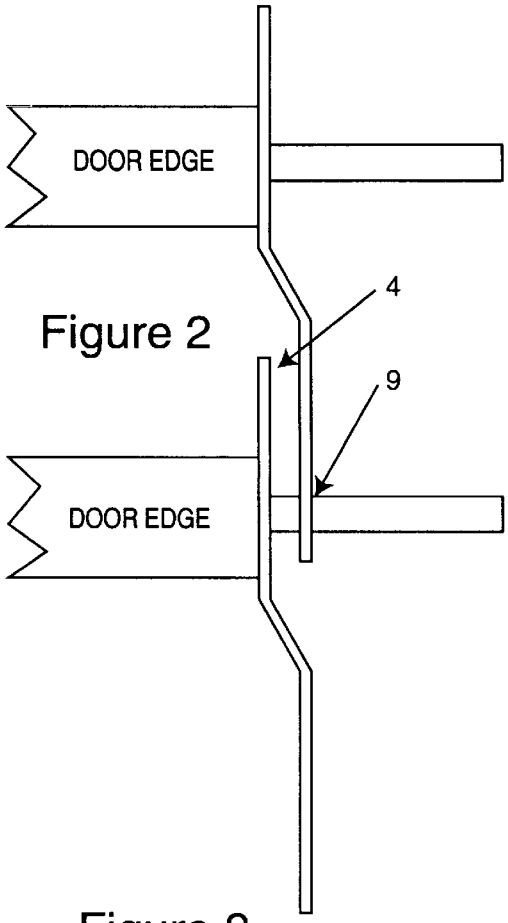
FIG. 2 is a side elevation of the fixture of FIG. 1 in combination with a fragmentary side elevation of doors.
Figure 3:
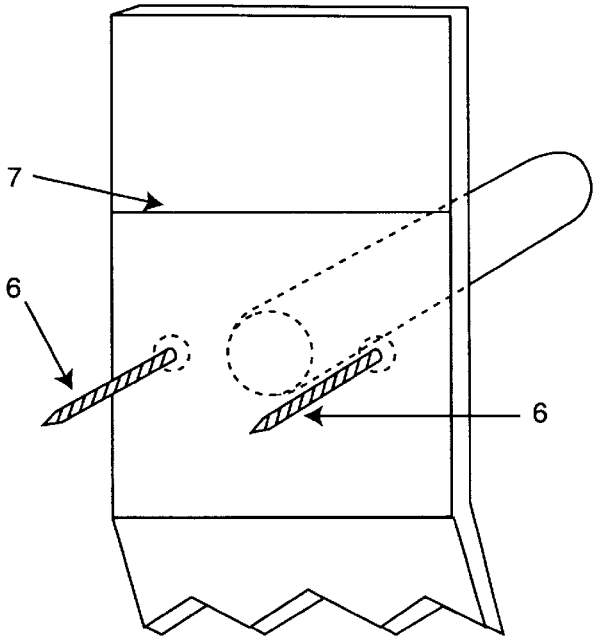
FIG. 3 is a fragmentary back perspective of the top end portion of the fixture of FIG. 1.
Figure 4:
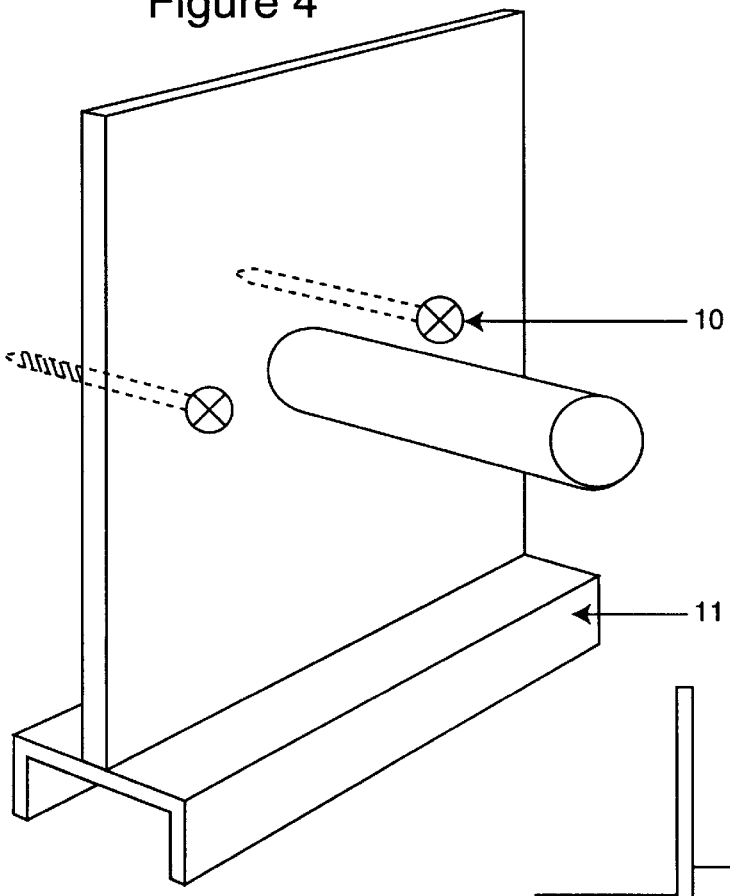
FIG. 4 is a front perspective of a door finishing support fixture in accordance with the present invention.
Figure 5:
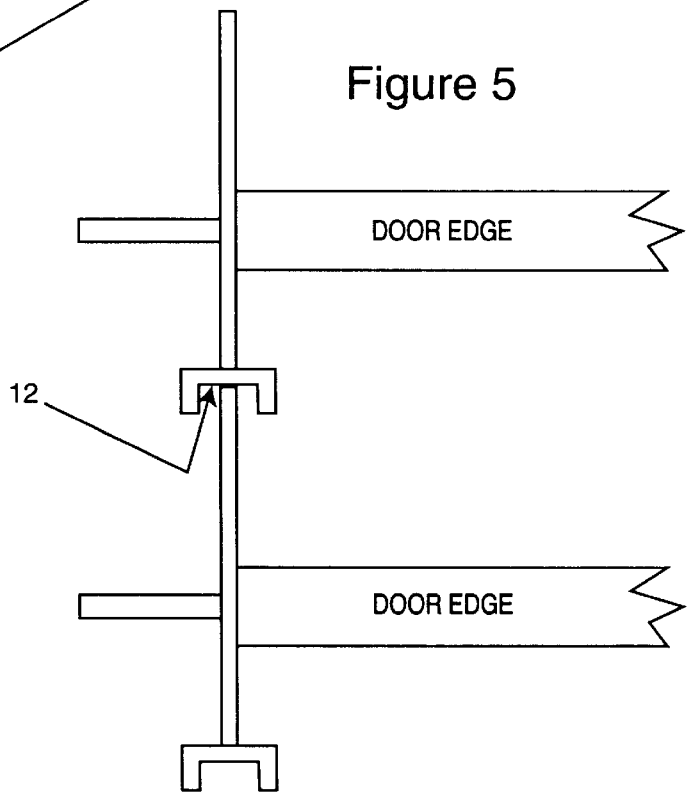
FIG. 5 is a side elevation of the fixture of FIG. 4 in combination with a fragmentary side elevation of doors.
Figure 6:
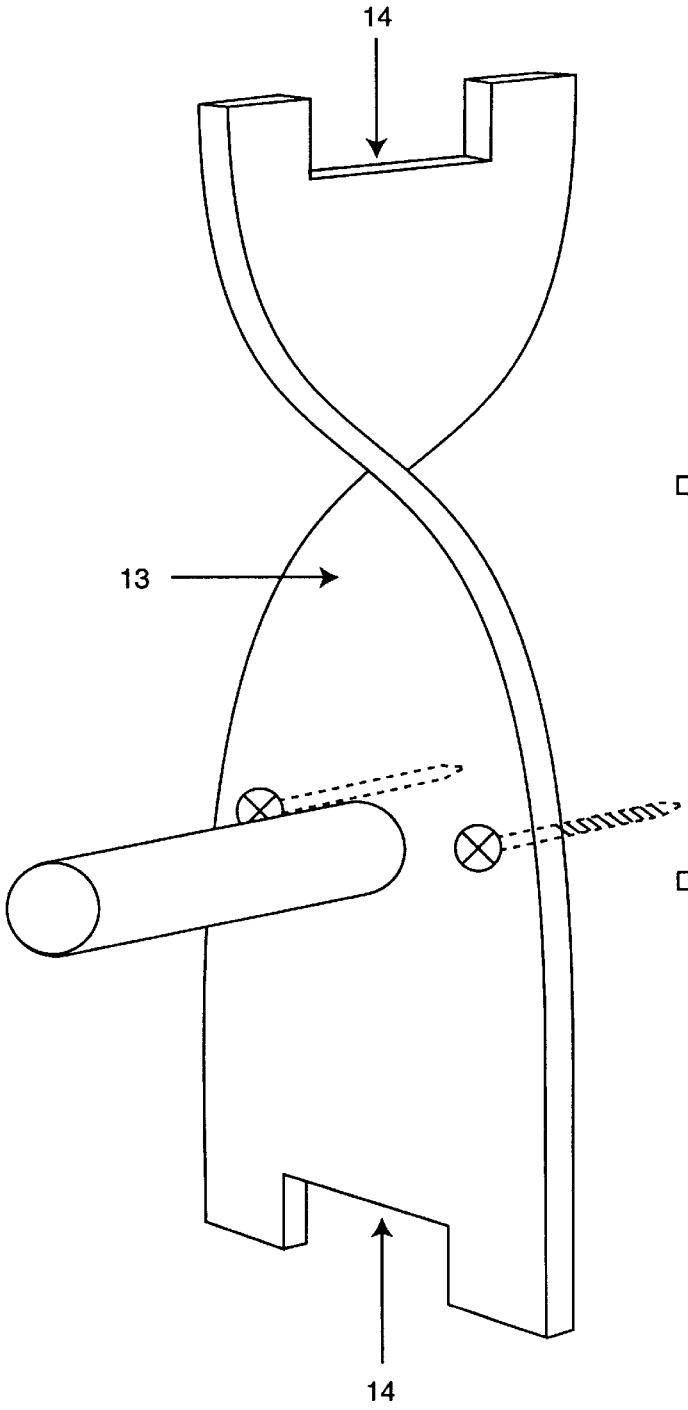
FIG. 6 is a front perspective of a door finishing support fixture in accordance with the present invention.
Figure 7:
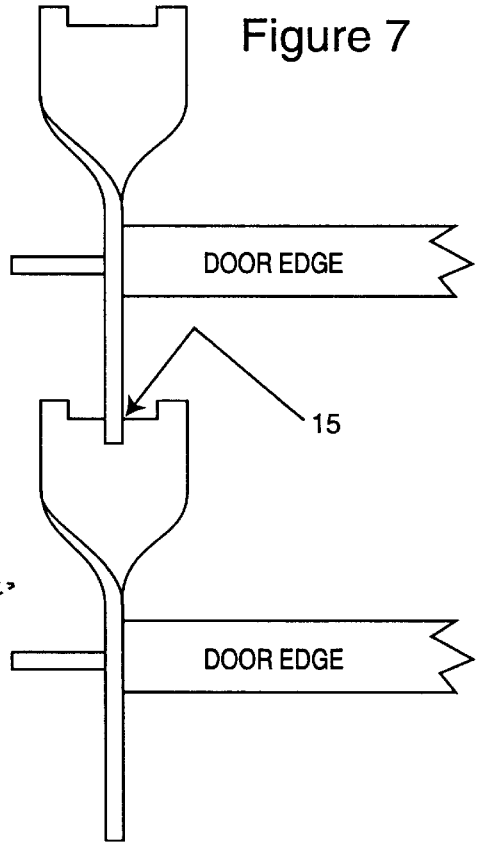
FIG. 7 is a side elevation of the fixture of FIG. 6 in combination with a fragmentary side elevation of doors.
Figure 8:
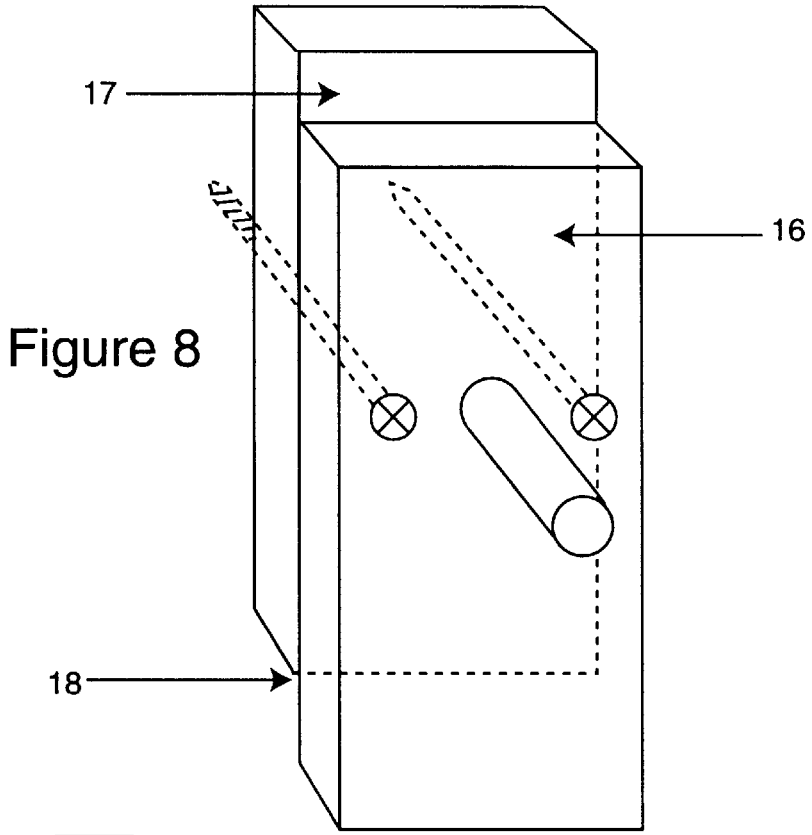
FIG. 8 is a front perspective of a door finishing support fixture in accordance with the present invention.
Figure 9:
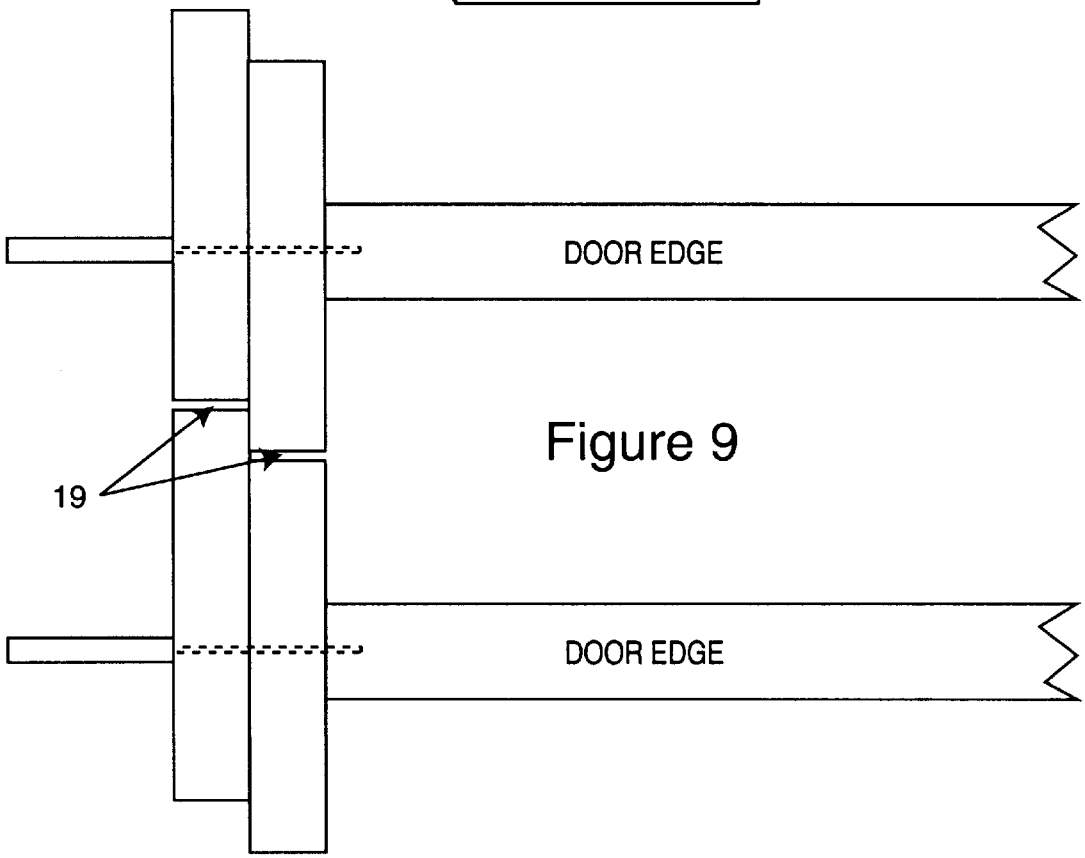
FIG. 9 is a side elevation of the fixture of FIG. 8 in combination with a fragmentary side elevation of doors.

As shown in the drawings, the preferred embodiment of a door finishing support fixture in accordance with the present invention has a main body 1 that is generally rectangular, with an overall length of approximately seven inches, and is preferrably of metal or strong plastic. The main body has a first lateral, approximately 40° bend upward 2 and a second lateral, approximately 40° bend downward 3 providing an offset between the top and the bottom of the main body 4.

A handle 5 of a general rod shape, preferrably of metal, wood, or plastic, is welded or otherwise attached at a right angle, generally central to the front surface of the main body.

The nail type fasterners 6 are welded or otherwise attached to the back of the main body directly opposite and to either side of the handle. These provide a means for attachment to a door. Alternatively, loose screws, nails or other such fasteners can be inserted into pre-drilled holes as a means for attachment to a door.

A marking or scoreline 7 aids in positioning the door finishing support on the door end.

The bottom of the main body is notched 8 so that it can loosely interconnect with the handle of another door finishing support fixture to facilitate stacking 9.

Alternatively, a main body 10 can be constructed in a generally rectangular shape of metal, plastic or other strong material, with a length of channel 11 of the same or other material welded or otherwise attached to the bottom of the main body providing a means by which it can loosely interconnect with the handle of another door finishing support fixture 12 to facilitate stacking.

Alternatively, a main body 13 of a generally rectangular shape can be constructed in which the top portion is turned 90° so as to be crosswise to the bottom portion resulting in a central portion having a twisted configuration. The top and bottom are notched 14 providing a means by which they can loosely interconnect with the top or bottom of another door finishing support fixture 15 to facilitate stacking.

Alternatively, a main body 16 can be constructed of wood, plastic, or other material, in which the top 17 and bottom 18 have been shallowly notched slightly greater than halfway through the horizontal thickness and on opposite sides. This allows the top of one door finishing support fixture to loosely interconnect with the bottom of another door finishing support fixture 19 to facilitate stacking.

The foregoing descriptions of alternate embodiments of the invention have been presented for the purposes of description and illustration. It is not intended to be exhaustive or to limit the invention to the precise form disclosed. Many modifications and variations are possible in light of the above teaching.

In use, a door, of the type commonly found in houses and other buildings, would typically be positioned flat and horizontally across two sawhorses or other such structures. The positioning marking on the door finishing support fixture would then be aligned with the face surface of the door at a corner on the top or bottom end of the door 20, and once aligned, attached using a hammer or similar tool by tapping on the end of the handle, thus nailing it to the door. Repeat this procedure until a support fixture has been attached to all four end corners of the door. The door support fixtures extend above both the front and back surfaces of the door and do not cover any part of the door surfaces that are to be finished. The door can now stand on the sawhorses on the "legs" created by the support fixtures 21, and one side of the door can now be finished. Immediately after finishing, and while the finish on the first side is still wet, the door can be turned to the other side using the handles 22 and two people, stood on the "legs" and the second side finished. Again, immediately after finishing the second side and while the finish is still wet on both sides, the door can be removed from the sawhorses and set aside on the "legs" until it has dried. After finishing a second door in the same fashion, the door can be stacked 23 on the previously finished door by positioning the notches of the four support fixtures on the second door on the handles of the support fixtures on the first door.

Once the door has dried, the support fixture can be removed with a hammer.

Door finishing support fixtures allow a door to be finished in the horizontal position to eliminate runs and sags in the finish, allow a door to be finished on both sides at one time, at a desireable working height away from dirt and debris on the floor, stacked to dry saving work area space, are small, portable, reuseable, inexpensive and simple to use.

A smaller, more open embodiment of a door finishing support fixture would adapt for use in finishing cabinet doors.

What is claimed is:

1. A system for supporting at least one workpiece having opposed planar side surfaces interconnected by peripheral narrow opposed edges during coating thereof, said system comprising:

a plurality of generally elongated upstanding inflexible support members, each support member including a top portion, a central portion, and a bottom portion, said central portion including generally rod shaped pointed tip fastener means for insertion into corner areas of said opposed edges of said at least one workpiece and an oppositely disposed generally rod shaped handle for positioning said at least one workpiece, said top and bottom portions of each support member being constructed to matingly engage and interconnect with respective top and bottom portions of another support member wherein said plurality of support members stably support and horizontally suspend a single workpiece but enable a plurality of same dimensioned workpieces engaged by additional support members to be stacked upon support members of said single workpiece such that said plurality of workpieces are evenly spaced apart and aligned but releasably connected and supportingly engaged.

2. The system as defined in claim 1, wherein each support member further comprises a notch in said top and bottom portions.

3. The system as defined in claim 1, wherein each support member comprises planar top and central portions and a channel shaped bottom portion wherein upon stacking of a plurality of support members, the planar top portion of one support member matingly engages the channel bottom portion of another support member.

4. The system as defined in claim 1, wherein said central portion comprises at least one of a bent and twisted configuration.

* * * * *